US007856859B2

(12) United States Patent
Aizpurua Plaza

(10) Patent No.: US 7,856,859 B2
(45) Date of Patent: Dec. 28, 2010

(54) RETRACTABLE KEY-HOLDER

(76) Inventor: Luis Maria Aizpurua Plaza, Eustasio Amilibia, 8, 9, San Sebastian (Gipuzkoa) (ES) 20011

( * ) Notice: Subject to any disclaimer, the term of this patent is extended or adjusted under 35 U.S.C. 154(b) by 0 days.

(21) Appl. No.: 12/497,229

(22) Filed: Jul. 2, 2009

(65) Prior Publication Data

US 2010/0005843 A1 Jan. 14, 2010

Related U.S. Application Data

(63) Continuation-in-part of application No. 11/572,792, filed as application No. PCT/ES2005/000359 on Jun. 24, 2005, now abandoned.

(30) Foreign Application Priority Data

Jul. 30, 2004 (ES) ..... 200401891

(51) Int. Cl.
*A44B 15/00* (2006.01)

(52) U.S. Cl. ..... 70/456 R; 70/458

(58) Field of Classification Search ..... 70/456 R, 70/458

See application file for complete search history.

(56) References Cited

U.S. PATENT DOCUMENTS

| | | | |
|---|---|---|---|
| 1,658,431 | A | 2/1928 | Dodson |
| 1,669,945 | A | 5/1928 | Michailovsky |
| 1,793,594 | A | 2/1931 | Dodson |
| 1,974,558 | A | 9/1934 | Andis |
| 2,047,331 | A | 7/1936 | Pollak |
| 2,245,381 | A | 6/1941 | Glenn |
| 2,306,970 | A | 12/1942 | MacPherson et al. |
| 2,580,600 | A | 1/1952 | Rom |
| 2,672,044 | A | 3/1954 | Martin |
| 2,696,101 | A | 12/1954 | Dysart |
| 2,793,523 | A | 5/1957 | Castro |
| 3,354,679 | A | 11/1967 | Le Fave |
| 3,362,200 | A | 1/1968 | Lanier |
| 3,436,942 | A | 4/1969 | Procter |
| 3,606,777 | A | 9/1971 | Watson |
| 3,745,799 | A | 7/1973 | Fagiano |
| 3,765,201 | A | 10/1973 | Humphrey |
| 3,837,190 | A | 9/1974 | Monk |
| 3,877,269 | A | 4/1975 | Dehart |
| 4,253,321 | A | 3/1981 | Sorensen |

(Continued)

FOREIGN PATENT DOCUMENTS

| | | | |
|---|---|---|---|
| CA | 2086350 | A | 6/1994 |

(Continued)

*Primary Examiner*—Suzanne D Barrett
(74) *Attorney, Agent, or Firm*—Lucas & Mercanti, LLP

(57) ABSTRACT

The present invention relates to a concealable key ring, including: a carrying plate with two side walls, at least one key ring axle mounted transversely between the two side walls, where the key ring axle has at least one slot made axially on the surface of the axle, a positioning pin having a body and two ends, the body of the positioning pin is partially mounted in the slot with the body partially extruding beyond the slot and the two ends of the positioning pin are fixed on the two side walls, and multiple keys each having a head with a transverse hole in the head where the perimeter of the hole has at least one groove made transversely through the head.

15 Claims, 2 Drawing Sheets

U.S. PATENT DOCUMENTS

| | | | |
|---|---|---|---|
| 4,888,970 | A | 12/1989 | Kinzler et al. |
| 5,199,560 | A | 4/1993 | Lee et al. |
| 5,943,889 | A | 8/1999 | Chiu |
| 6,141,999 | A | 11/2000 | Whittaker et al. |
| 6,705,141 | B1 | 3/2004 | Jacob et al. |
| 6,892,558 | B2 | 5/2005 | Chodosh |
| 7,055,352 | B2 | 6/2006 | Meyerson et al. |
| 2006/0086163 | A1 | 4/2006 | Downes |

FOREIGN PATENT DOCUMENTS

| | | | |
|---|---|---|---|
| CH | 684349 | A | 8/1994 |
| EP | 1327397 | A | 7/2003 |
| ES | 162339U | A | 11/1970 |
| WO | 9635349 | A | 11/1996 |

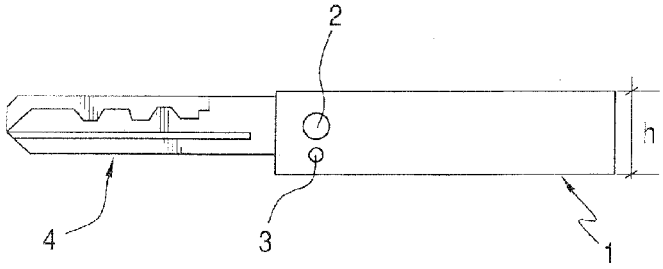
FIG. 4
FIG. 5
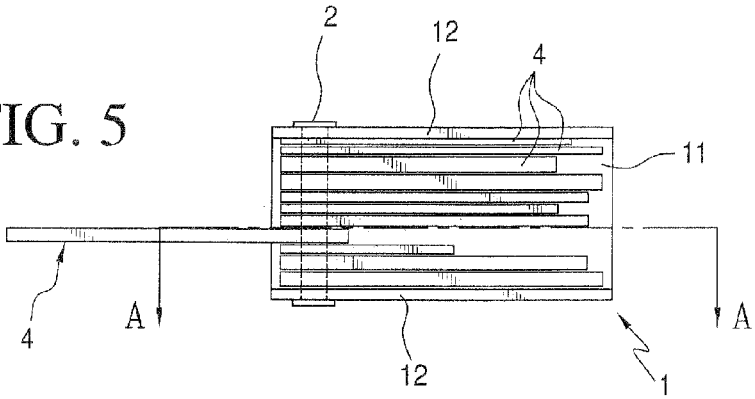
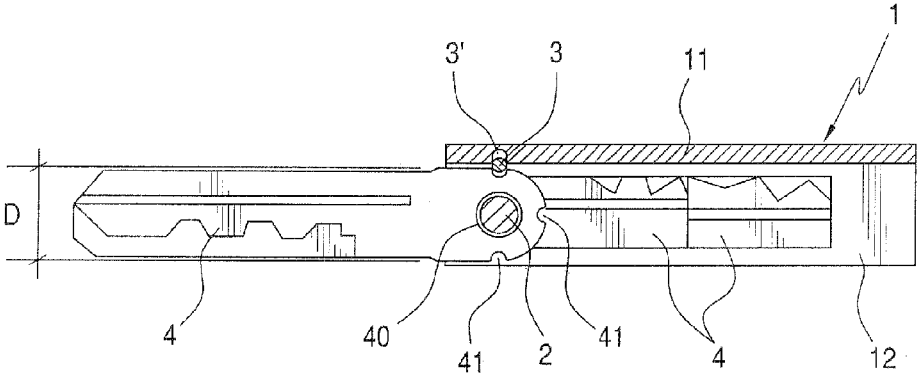
FIG. 6
FIG. 7
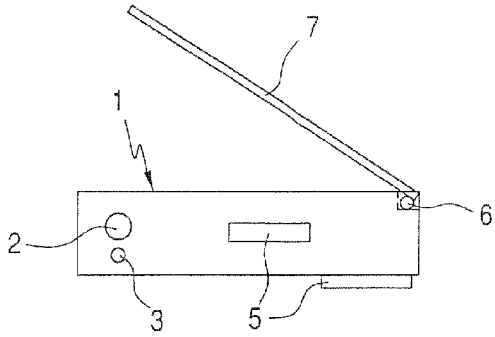

RETRACTABLE KEY-HOLDER

CROSS-REFERENCE TO RELATED APPLICATION

This application is a Continuation in Part of prior application Ser. No. 11/572,792 filed on Jan. 26, 2007, which is a national application of PCT/ES2005/000359, filed Jun. 24, 2005, which in turn claimed the priority of Spanish Patent Application No. P-200401891, filed Jul. 30, 2004, the contents of all three applications are incorporated herein by reference.

FILED OF THE INVENTION

The object forming the subject of the present invention consists of a key ring in particular, or an object-holder, in more general terms, in which keys or objects of whatever kind, such as nail-cutters, knife blades, nail files or similar objects are arranged so that they can be opened out for use and stowed away when not being used.

BACKGROUND OF THE INVENTION

One problem common to all conventional key rings is their inconvenience due to the considerable volume occupied by the keys. Such problems are even more pronounced when they hold a considerable number of keys, for example, in caretaker's offices for large blocks of apartments, in schools and other public institutions or similar places.

Further, secondary problems include both wear and tear on doors and frames caused by keys other than the one that is being used carried on the same key ring, excessive weight and/or volume of the set, noise during the use, which bothers the user as well as the exposed edges damaging the user's pockets.

The object forming the subject matter of this invention avoids these problems.

SUMMARY OF THE INVENTION

The present invention relates to a concealable key ring, comprising: a carrying plate with two side walls, at least one key ring axle mounted transversely between the two side walls, where the key ring axel has at least one slot made axially on the surface of the axle, a positioning pin having a body and two ends, the body of the positioning pin is partially mounted in the slot with the body partially extruding beyond the slot and the two ends of the positioning pin are fixed on the two side walls, and multiple keys each having a head with a transverse hole in the head where the perimeter of the hole has at least one groove made transversely through the head.

It further relates to a concealable key ring, comprising: a carrying plate having two side walls and a base plate connecting the two side walls, at least one key ring axle mounted on the two side walls and with its axis transversely between the two side walls, where the base plate has a slot made transversely between the two side walls in a position vertically underneath the axis of the ring axle, a positioning pin with its body mounted partially in the slot partially extruding beyond the slot, the pin has its two ends fixed on the two side walls, and multiple keys each having a head with a transverse hole in the head where the outer perimeter of the head has at least one groove made transversely through the head.

In these embodiments, when the keys are rotatably arranged on the axle with the axle extending through the hole, the positioning pin fits into the groove(s) on the head so that to hold the keys at a desired angle.

The present invention is a concealable key ring that can hold a large number of keys in a minimum amount of space, arranged in such a way that the only one key opened out is the one in use, with the remainder of the keys being completely stowed inside the cavity formed by the carrying plate having side walls, so that the keys do not protrude out of the cavity.

The aforementioned opening of the single key in use forms an angle ($\alpha$) with respect to the rest of the keys stowed as one set which is always kept firm and tight; thus, while one key is being used, the key ring and the other keys are kept away from the door so as to avoid scratching either the door itself or the frame around it.

Furthermore, the maximum size of each key is the same or less than the height of the side walls of the carrying plate and the maximum size of the head of each key is about the same as the width of the bit. Compliance with this dual condition means that the size of the key ring is considerably reduced.

The concealable key ring, according to the invention, is characterised by the fact that it consists of a carrying plate having two lateral walls, mounted between which there is at least one axle to hold the keys, arranged in such a way that the keys can be rotated, and at least one positioning pin for these keys, which, by acting in combination with at least one corresponding groove made in the head of each key, can set the key to an opened position. Preferably at least 3 grooves which to set the key to the position at an opened position (180°), a perpendicular position (90°) and a closed position (0°). There should be at least one intermediate position with an angle between the angle of the closed position and the straight angle in the fully opened position.

The maximum size of the head of each key is the same or less than the height of the side walls of the carrying plate and is about the same as the width of the bit.

The aforementioned pin is made of material that is elastically deformable so as to facilitate its housing in or extraction from the corresponding grooves in the keys.

Incorporated in the object of the invention are specific and/or alternative arrangements that do not alter, change or modify the essential nature of the object proposed, and in particular:

- the fact that there can be either only one axle holding the keys or more than one;
- that the keys can either be arranged one against another or in some other ways, with the toothed edges of the bits all facing the same way;
- that, in each key, there can be one or several grooves, so that the keys can be opened out in one or several positions, with an angle ($\alpha$) at various different degrees defined between the central lines of the key opened out for use and the rest of the set stowed in the cavity;
- that each carrying plate can include any additional fixing means, whether magnetic or mechanical, to keep the object fixed in a holding place (such as a key ring cabinet, for instance).

Also included in the scope of the invention are any further addition or modifications concerning accessories, construction and/or design that do not alter the object of the invention, and in particular:

- that either the pin or the areas where the grooves have been made—or both—should be made from material that is elastically deformable via conventional methods;
- that the side walls of the carrying plate may or may not be connected together by means of a base plate, and
- that the slot (3') accommodating the pin can be made either on the axle or on the base plate, where a part of the pin protrudes out of the slot (3'), so that the pin also fit into the grooves in the appropriate areas of the key.

BRIEF DESCRIPTION OF THE DRAWINGS

So as to have a better understanding of the object forming the subject mater of this invention, the diagrams show the best way to go about its practical production, susceptible to changes due to the incorporation of accessories that do not alter its basic conception.

Figure 1:
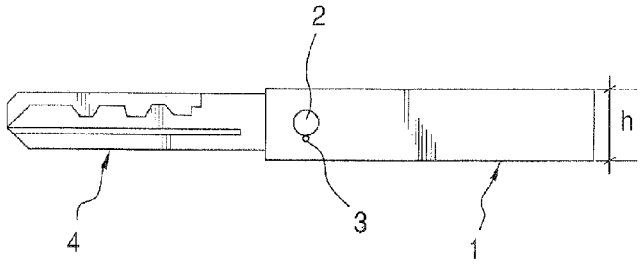
FIG. 1 shows a general elevation view of a concealable key ring according to the invention with one key (4) opened out at a straight angle and the rest in a stowed position.

In these diagrams, the pin (3) fits into a slot (3') in the axle (2) and the keys (4) have the grooves (41) made around the perimeter of the hole (40).

Figure 2:
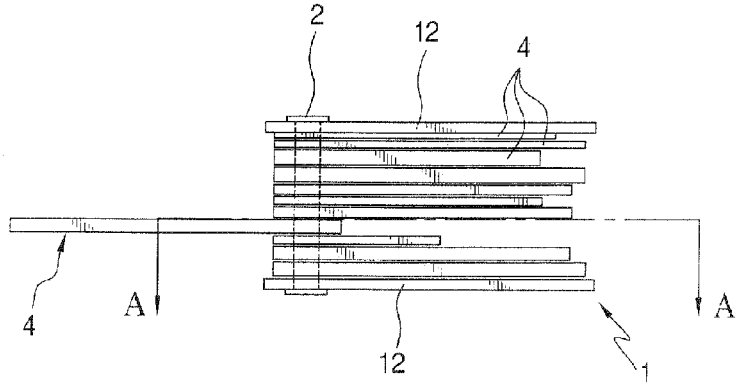
FIG. 2 shows a plan view of the same object illustrated in the previous diagram.
Figure 3:
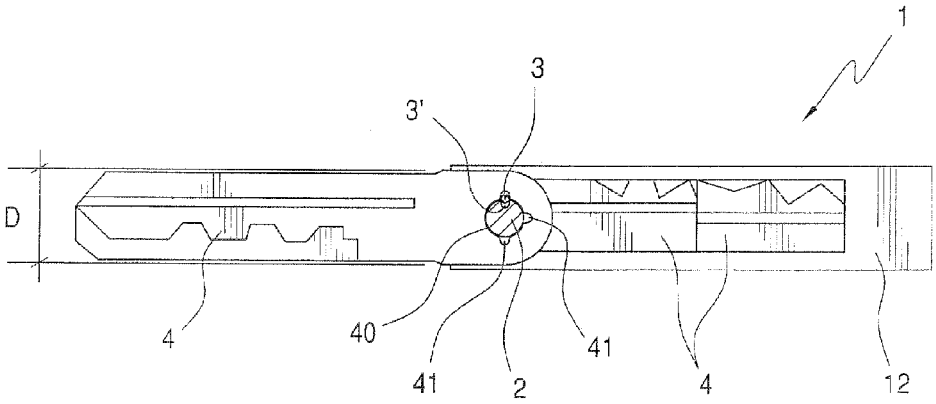
FIG. 3 shows a section view, as indicated by the line of A:A, in FIG. 2.

FIGS. 4, 5 and 6 show views that are equivalent to the previous FIGS. 1, 2 and 3 respectively for alternative arrangements, in which the side walls (12) of the carrying plate (1) are connected by means of a base plate (11) and the pin (3) fits partially inside a slot (3') made transversely in this plate (11). The keys (4) have the grooves (41) around the outer perimeter of their heads.

FIG. 7 shows a similar view to FIG. 4, with all the keys (4) stowed inside and for an alternative arrangement providing a cover (7) and second axle (6) for fixing the cover to the side of carrying plate (1), and fixing means (5) fixed on the carrying plates (1) to fix the device to a fixed surface.

DETAILED DESCRIPTION OF THE INVENTION

There now follows a description of one practical arrangement, which is not intended to be limiting in any way, of the present invention.

The object forming the subject mater of the present invention is a concealable key ring, which basically consists of a carrying plate (1), keys (4) and the means both for arranging the keys (4) on the carrying plate (1) so that they can rotate—reaching a concealed position and other positions when opened out—and also for positioning/retaining such keys (4) in at least one of these positions.

Furthermore, the concealable key ring forming the subject matter of this invention may also have:

- a cover (7) hiding the keys (4) from view when they are in their stowed position; and/or
- fixing means (5) for being fixed to the other adjacent carrying plates or to fix such carrying plates (1) to a main carrying plate; and/or
- means of fixing the carrying plate (1) to a snap ring, such as a ring or a hole for example.

In line with the invention, and according to the arrangement shown—see FIGS. 1 and 2—the carrying plate (1) having two side walls (12) with minimum size, on which at least one key ring axle is mounted (2) holding the keys (4), which can be rotated; for this purpose, the keys (4) have a hole (40) in their head so that the axle (2) can go through the hole.

There is also at least one positioning pin (3) mounted on the walls (12). There is a positioning pin (3) for each key ring axle (2).

For the arrangement illustrated in FIGS. 1 to 3, the pin (3) fits inside an accommodating slot (3') made in the axle (2) and the grooves (41) are made around the perimeter of the hole (40) of the head of the keys (4).

For the arrangement illustrated in FIGS. 4 to 6, the carrying plate (1) also has a base plate (11), connecting the side walls (12) to each other along one of their edges, so that the keys (4) are limited to rotating in 180°.

In this arrangement, the pin (3) fits partially in a slot (3') made transversely in this base plate (11) and the grooves (41) are made around the outer perimeter of the head of the key (4).

In either of the two arrangements, the pin (3) is made of material that is elastically deformable via conventional methods, such as rubber or similar material and is over-sized with respect to the slot (3'). This over-sized pin has a part that reaches a groove (41) in the key (4), and another part fits to the slot (3'), thereby retaining the key at that specific angle.

As an alternative, without altering the essential nature of the model in any way, the pin (3) and the slot (3') in which it is partially fit can be made of a stiff material, while the area around the key (4) being elastically deformable, in which the grooves (41) are made.

In any of the various arrangements, depending on the position of this groove (41), angle ($\alpha$), which is formed by the key (4) when it is opened out with respect to the carrying plate (1) and with respect to the remainder of the keys (4) in the stowed position, will be different.

Preferably, one of the grooves (41) is made in such a way that the key (4) that is opened out will form a right angle (i.e. $\alpha$=90°), although grooves (41) can be made in any part of the perimeter around the head of the key (4) so that the key (4) that is opened out forms any type of angle ($\alpha$) with respect to the carrying plate (1) and with respect to the remaining keys (4) that are in the stowed position. In FIGS. 3 and 6 three grooves (41) have been made at 90° between one and another.

Logically, the key ring axle (2)—or each existing key ring axle (2)—can be dismounted from the carrying plate (1) so as to be able to put on or take off the keys (4) from the concealed key ring.

In the concealed key ring, according to the invention, the maximum dimension (D) of the head of each key (4) is the same or less than the height (h) of the side walls (11) of the carrying plate (1) and is about the same as the width of the bit. With the keys (4) fulfilling this dual condition, it is possible to reduce the overall size of the key ring quite considerably.

The concealable key ring forming the subject matter of this invention has also been designed to have a cover (7), to hide the keys (4) from view when they are stowed inside the carrying plate (1).

This cover (7) can be mounted on a second axle (6) for instance, with the possibility of rotating between two opening/closing positions—see FIG. 7.

Furthermore, each carrying plate (1) incorporates the fixing means (5) for being fixed to other adjacent carrying plates—such as magnets, for example, mounted on the outside of at least one of the side walls (12); or for these carrying plates (1) to be fixed to a fixed surface (for example a flat metal plate)—where the magnets can also be mounted on the outside of the base plate (11).

The concealable key ring forming the subject matter of this invention is also designed to include other means such as holes or rings for fixing it to a snap ring, or to hang it in a key ring cabinet in a similar way to the way normal conventional key rings are hung up.

The invention claimed is:

1. A concealable key ring, comprising:

a carrying plate having two side walls;

at least one key ring axle mounted transversely between the two side walls where the key ring axle has at least one slot made axially on the surface of the axle;

a positioning pin fit partially in the slot and mounted transversely between the two side walls; and multiple keys each having a bit and a head with a transverse hole in the head where the perimeter of the hole has at least one groove made transversely through the head, so that when the keys are rotatably arranged on the axle with the axle extending through the hole and the positioning pin partially fits into the groove in the hole to hold the keys at a position.

2. A concealable key ring, comprising:

a carrying plate having two side walls and a base plate connecting the two side walls where the base plate has a slot made transversely between the two side walls;

a positioning pin fit partially in the slot and mounted transversely between the two side walls;

at least one key ring axle mounted transversely between the two side walls; and multiple keys each having a bit and a head with a transverse hole in the head where the outer perimeter of the head has at least one groove made transversely through the head, so that when the keys are rotatably arranged on the axle with the axle extending through the hole, the positioning pin fits partially into the groove on the head to hold the keys at a position.

3. The concealable key ring, according to claim 1, wherein a maximum dimension of the head of each key is the same as or less than a height of the side walls of the carrying plate and is about the same as a width of the bit.

4. The concealable key ring, according to claim 1, wherein the pin is made of elastically deformable material.

5. The concealable key ring, according to claim 1, wherein the pin is of a stiff material and the area of the key where the grooves are made, is of elastically deformable material.

6. The concealable key ring, according to claim 1, wherein, each carrying plate includes a fixing means to fix to other adjacent carrying plates or to fix to a fixed surface.

7. The concealable key ring, according to claim 6, wherein said fixing means consist of magnets, arranged on a base plate and/or at least one of the side walls of the carrying plate.

8. The concealable key ring, according to claim 1 further comprises at least one side wall of the carrying plate includes a ring or a hole for fixation.

9. The concealable key ring, according to claim 2, wherein a maximum dimension of the head of each key is the same as or less than a height of the side walls of the carrying plate and is about the same as a width of the bit.

10. The concealable key ring, according to claim 2, wherein the pin is made of elastically deformable material.

11. The concealable key ring, according to claim 2, wherein the pin is of a stiff material and the area of the key where the grooves are made, is of elastically deformable material.

12. The concealable key ring, according to claim 2, wherein, each carrying plate includes a fixing means to fix to other adjacent carrying plates or to fix to a fixed surface.

13. The concealable key ring, according to claim 12, wherein said fixing means consist of magnets, arranged on a base plate and/or at least one of the side walls of the carrying plate.

14. The concealable key ring, according to claim 2 further comprises at least one side wall of the carrying plate includes a ring or a hole for fixation.

15. The concealable key ring, according to claim 2, further comprises that the carrying plate has a second axle at one end of the side walls, a hinged cover is mounted on this second axle, hiding the keys from view when the keys are in a stowed position.

* * * * *